US005492333A

United States Patent [19]

Oplinger

[11] Patent Number: 5,492,333

[45] Date of Patent: Feb. 20, 1996

[54] TILES WITH HANDEDNESS FOR GAMES AND PUZZLES

[75] Inventor: Frederick K. Oplinger, Berea, Ohio

[73] Assignee: Family Home Games, Inc., Berea, Ohio

[21] Appl. No.: 427,805

[22] Filed: Apr. 26, 1995

[51] Int. Cl.[6] ..... A63F 9/20

[52] U.S. Cl. ..... 273/294; 273/293; 273/157 R; D21/51

[58] Field of Search ..... 273/293, 294, 273/157 R; D21/51, 44–46, 42, 43

[56] References Cited

U.S. PATENT DOCUMENTS

| | | | |
|---|---|---|---|
| 3,687,455 | 8/1972 | Odler | 273/157 R |
| 3,806,127 | 4/1974 | Pink | 273/294 |
| 4,225,139 | 9/1980 | Cosmopulos | 273/294 |

FOREIGN PATENT DOCUMENTS

| | | | |
|---|---|---|---|
| 2692805 | 12/1993 | France | 273/303 |

*Primary Examiner*—Benjamin H. Layno

*Attorney, Agent, or Firm*—Fay, Sharpe, Beall, Fagan, Minnich & McKee

[57] ABSTRACT

A set of game tiles, each game tile having a like back and a face (30). On a face (10), each game tile carries a suit indicia (32) and a rank indicia (34). The suit and rank indicia are color coded or a combination of color and letter or number codes. Optionally, a tile value indicia (44) appears centrally on the face. Each of the tiles has a pair of wings (12, 14) that extend upward from the base with an angle (20) between their central axes. The angle between the central axes is less than 180° are preferably greater than 90° such that the tiles have handedness, i.e., unique left and right sides. In this manner, even when the rank and suit indicia are color coded with like colors, the rank and suit indicia can still be differentiated. Preferably, the tiles are relatively thick so that the tiles can be stood vertically on the base (10).

20 Claims, 3 Drawing Sheets

TILES WITH HANDEDNESS FOR GAMES AND PUZZLES

BACKGROUND OF THE INVENTION

The present invention relates to table games and puzzles. It finds particular application in conjunction with an improved tile which is suitable for use in playing a variety of table games and will be described with particular reference thereto.

Traditional game tiles, such as a domino tile, lack "handedness". That is, which tiles are reversible and may be played in either direction.

Such prior art tiles are typically linear. Typically, they are rectangular and are often divided into two square sides. Each symmetric side can be abutted with other tiles to form linear or rectangular chains.

Such prior art domino tiles are marked on either end with a rank or number. There is no suit designation.

Such prior art linear tiles with rank and no suit find application in only a limited number of games, most notably series building games, such as dominos.

Mah Jong tiles have both suit and rank but lack handedness. These rectangular tiles having both suit and rank but lacking handedness find application in only a limited number of games.

The present invention contemplates a new and improved tile which overcomes the above-referenced limitations and is readily adaptable to many types and classes of games.

SUMMARY OF THE INVENTION

In accordance with one aspect of the present invention, a new and improved game tile is provided. The tile includes a base from which first and second wings extend. Each wing has a central axis. The axes cross at an angle of less than 180°. A rank indicia is located on a face of the tile on the first wing and a suit indicia is located on a face of the tile on the second wing.

In accordance with one more limited aspect of the present invention, the central axes cross at a angle greater than 90°.

In accordance with another more limited aspect of the present invention, the rank and suit indicia include a color encoding, an alpha-numeric encoding, or a combination of color and alpha-numeric encodings.

In accordance with another more limited aspect of the present invention, the base has sufficient thickness that the tile is able to stand on the base.

In accordance with yet another more limited aspect of the present invention, the game tile includes one or both of a value indicia and secondary suit and rank indicia located adjacent the base.

In accordance with another aspect of the present invention, a set of game tiles is provided. The set of game tiles includes a plurality of like shaped tiles, with each tile having a face and a back. The back of each tile is substantially the same. Each tile has a pair of wings which extend from the base at an angle relative to each other such that the tile has handedness. Each tile has a suit indicia on one wing and a rank indicia on the other wing. The set of tiles includes a plurality of subsets of tiles. Each subset of tiles is marked with a corresponding one of a plurality of suit indicia. A first of the subsets of tiles is marked with a first suit indicia and includes a tile marked with each of a plurality of rank indicia. A second of the subsets of tiles is marked with a second suit indicia and includes a tile marked with each of a plurality of rank indicia.

One advantage of the present invention is that the tiles are amenable to numerous types and classes of games. Such different types and classes of games include racing games, trick taking games, set building games, sequence building games, matching games, and the like.

Another advantage of the present invention is that in one embodiment, the tiles are adapted to stand vertically. Unlike cards, the tiles need not be held in the players hand, facilitating play by children, adults with arthritis, and the like.

Another advantage of the present invention is that the tiles can be mated to make a myriad of colorful patterns and designs.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENTS

Figure 1:
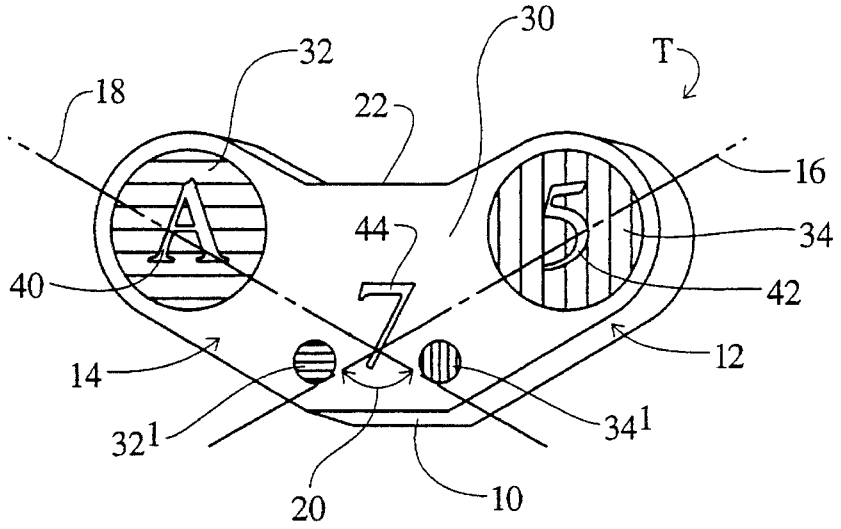
FIG. 1 is a perspective view of a tile in accordance with the present invention.

With reference to FIG. 1, a tile T has a generally flat base 10. The base, in the illustrated embodiment, has sufficient width that the tile can be stood easily and stably on its base. Thinner tiles that are held by the players or rest on a stand are also contemplated. The tile includes a pair of wings 12, 14, which extend upward at angles from the base 10. More specifically, each of the wings extends generally parallel to a pair of axes 16, 18 which cross with an angle 20. The angle 20 is less than 180° and is, preferably, greater than 90°. In the illustrated embodiment, the angle 20 is about 120° which enables three tiles to be mated at their base areas and facilitates the formation of triangular and hexagonal configurations. The tile has a generally flat, central top portion 22 sized to receive the base portion 10. This enables the tiles to be stacked or nested. In the illustrated embodiment, each of the wings 12, 14 has generally rounded ends. Of course, ends of other configurations such as rectangular, pointed, piece-wise linear, enlarged circles, or the like are also contemplated.

Each of the tiles has a face 30 (towards the viewer in FIG. 1) and a back (into the paper in FIG. 1). On the back, each tile is the same so that the tiles cannot be identified from the back. The face 30 includes suit indicia 32 and a rank indicia 34. In one preferred embodiment, the suit indicia is on the left wing and the different suits are indicated by different colors. Analogously, in the illustrated embodiment, the rank indicia is on the right and different ranks are indicated by different colors. Of course, the suit and rank indicia can be reversed and in some games, such as color matching games, the indicia 32, 34 are not used to distinguish suit and rank.

Figure 2:
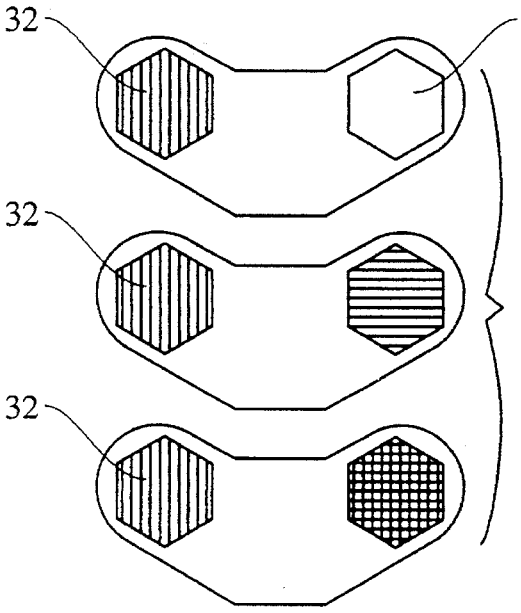
FIG. 2 illustrates a set of tiles of the same suit in accordance with one embodiment of the present invention.

With respect to FIG. 2, a set of tiles with the same suit and different rank is illustrated. The common colored left-hand indicia 32 indicates the same suit in each tile while different colors in the right-hand side show different ranks. In this manner, a "run" in the same suit can be generated in a rummy-type game. A full deck has several suits, e.g., 7, typically with cards of the same ranks in each suit. Optionally, an eighth suit may be provided for use in games which need an even number of suits.

Figure 3:
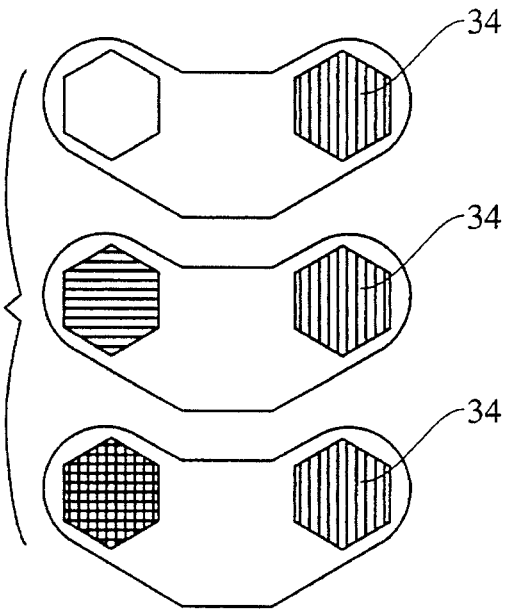
FIG. 3 illustrates another set of tiles of the same rank but of different suits, i.e., three-of-a-kind.

FIG. 3 illustrates a set of tiles in which the rank or right-hand indicia is constant or is the same and the left-hand or suit indicia 32 is different in each tile. A set with the same rank and different suits is illustrative of three-of-a-kind in a rummy-type game.

With reference again to FIG. 1, the suit wing 14 further carries a letter indicia 40. In the preferred embodiment, the letter and color indicia are coordinated. That is, the letter "A" always appears on the same color background. Other letters each appear on their own color background. In this manner, the letter and color indicia are both indicators of a common quantity, e.g., suit. Of course, games and tiles in which the color and letter or other second indicia 40 are not coordinated are also contemplated. Analogously, the right-hand or rank wing 12 carries a second indicia 42, such as a number indicia. Again, in the preferred embodiment, the number indicia 42 is coordinated with the color indicia 34. That is, a "1" always appears on one color background, a "2" always appears on another color background, and so forth. In the preferred embodiment, common colors are used for both the rank and suit indicia 32 and 34 to facilitate matching of the tiles end-to-end in matching games.

In the embodiment of FIG. 1, each tile further carries a value indicia 44. The value indicia indicates a value of the tile for trick taking, score keeping, or matching purposes. Further, each tile carries a second pair of color indicia 32', 34'. In the preferred embodiment, the secondary pair of color indicia 32' is the same color as the suit color indicia 32 and the secondary color indicia 34' is the same color as the rank color indicia 34. The secondary color indicia facilitate chaining the tiles base-to-base in matching games.

Numerous other matching games are also contemplated. Tiles may be matched and joined end-to-end in many ways including syndiotactic, isotactic, and atactic forms. These forms are purely a matter of handedness and do not necessarily require that the adjacent indicia must match, although in many games they do.

Figure 4:
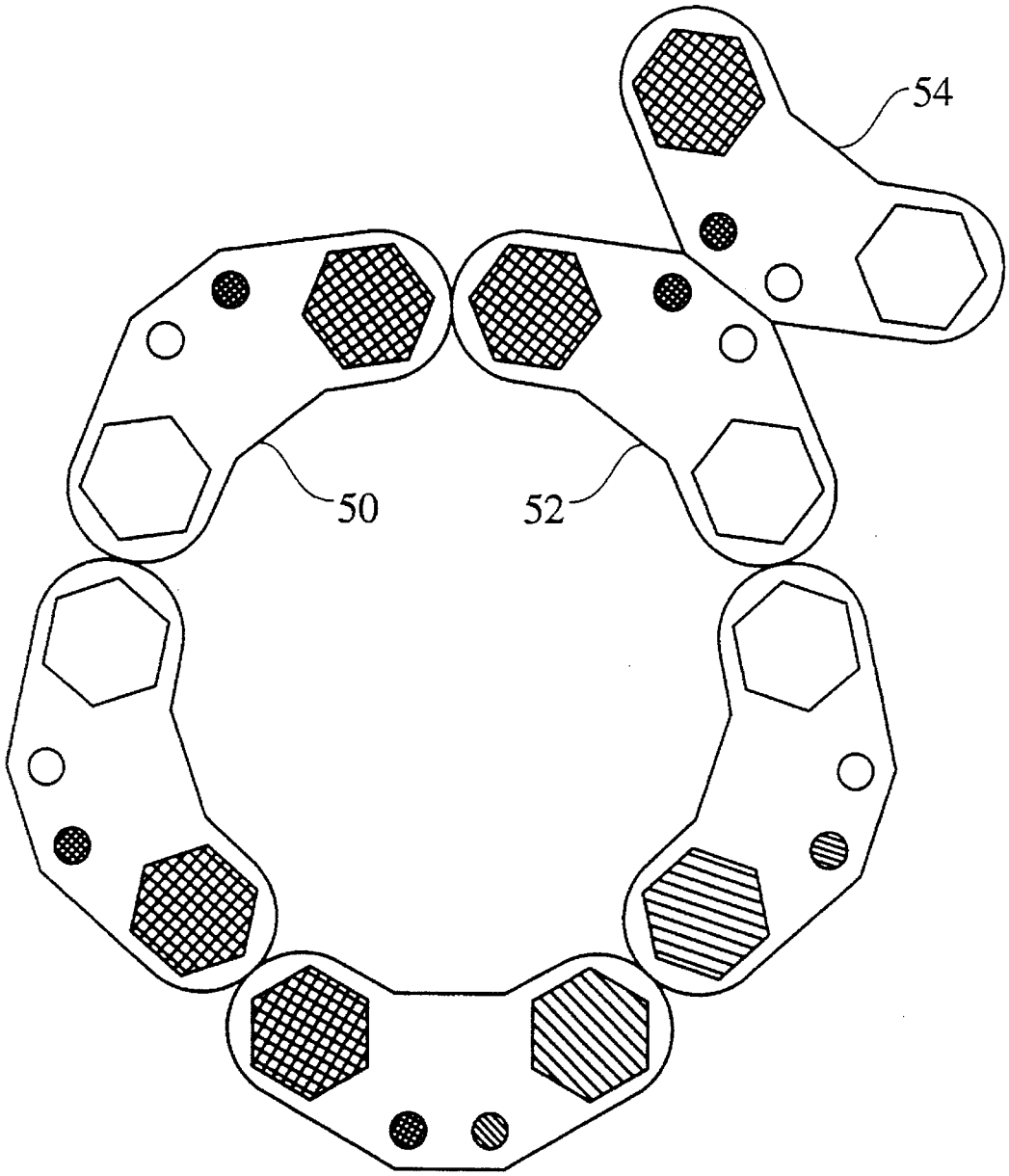
FIG. 4 illustrates a circular chain of tiles made by matching symbols of the tiles left to right; and, FIG. 5 illustrates a spiral layout for a racing game.
Figure 5:
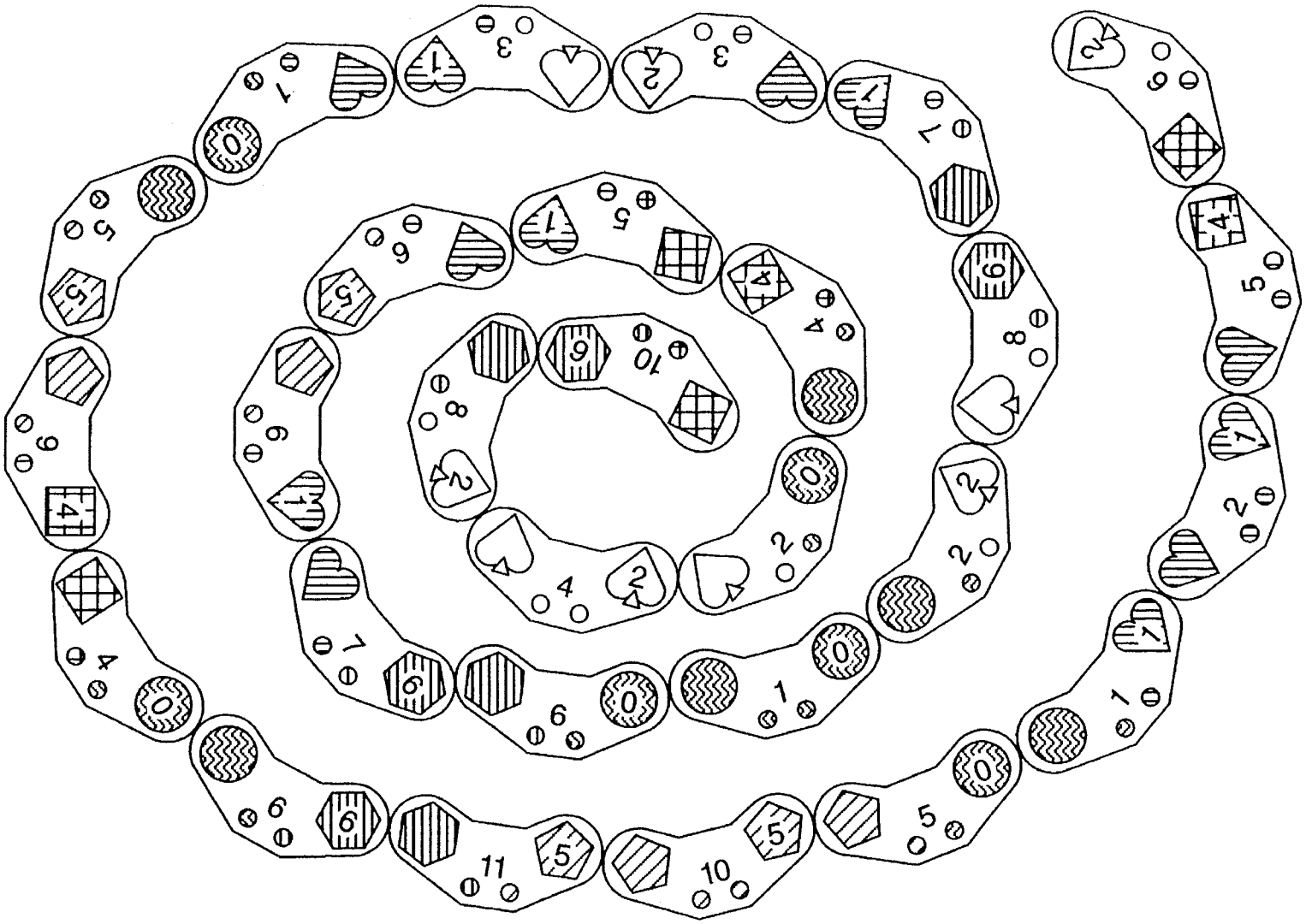

Syndiotactic is uniform left+right, left+right, left+right, . . . or left+left, right+right, left+left, . . . Syndiotactic produces chains of tiles which may be of a special form such as rings and spirals. FIGS. 4 and 5 are examples of left+right syndiotactic.

Isotactic is uniform left+left+left+ . . . and/or right+right+right+ . . . Isotactic matching on both sides produces stacks or nested columns of tiles. FIG. 2 is an example of isotactic left+left+left and right+right+right. Isotactic left+left+left alone would produce a three-bladed propeller shape. The atactic matching is a non-uniform arrangement. The rules of the particular matching game will specify whether syndiotactic, isotactic, and/or atactic matching is permitted.

With reference again to FIGS. 2 and 3, in one exemplary sequence and matching game, all tiles are turned face down. Each player draws nine tiles and sets them on end or in a support rack so only that player can see them. The players take turns drawing and discarding from the face down tiles or tiles discarded by other players. The winner is the first player that builds three sets of three tiles in which each set of three tiles either (1) is of the same suit and has sequential numbers or (2) is of the same rank and has different suits.

With reference to FIG. 4, the handedness of the tile in combination with encoding symbols enables one tile to be matched to another in terms of left and right. In another exemplary matching game, each player draws six tiles and sets them on end or in the rack. A first player plays a pair of tiles that have a correctly matching color, such as tiles 50, 52. Correct matching is left+right syndiotactic with adjacent colors matching. Subsequent players may play individual tiles which correctly match a previously played tile. If the next player cannot play, the player draws from the reserve until he/she can. When a chain of 4 tiles, for example, has been formed, a subsequent player may match both ends of the chain with his/her tile to form a ring. As illustrated by tiles 52, 54, a branch may be created by playing a pair of tiles base to base whose secondary indicia colors match. The winner is the first player to play all of his/her tiles.

The tiles can also be used for playing trick-taking games. For example, each player draws an equal number of tiles from a face-down reserve. One player plays a tile. The other players must follow suit, i.e., must play a tile with the same indicia 32. The tile with the highest rank takes the trick. In one variation, one suit may be designated as trump. A player with a void in the lead suit may trump. Analogously, a player that is void in the lead suit may play a tile of another suit which is not trump but cannot take the trick. The player who takes the most tiles during play is the winner. In one variation, rather than counting tiles, the players add the value 44 of the tiles within the tricks which they have taken. In a more sophisticated version, the trick-taking game is played by four players with players opposite to each other working as partners. Trump is decided by bidding.

In another game, all tiles are turned face-down in the reserve. A first player turns over tiles until that player turns over a tile with a red, for example, indicia in either the rank or suit location. At that point, the players turn is over and the next player gets a turn to draw. The player keeps all of the tiles drawn before the red tile is turned up. When all tiles have been drawn from the reserve, the players sum the value 44 of the tiles which they collected. High score wins.

In another game, all tiles are placed face-down. Each player takes turns turning up two tiles face-up. If the two tiles have the same colors (the suit and rank colors may be reversed) or if the value numbers 44 add to ten, then that player keeps the two tiles. If neither of these conditions is met, the player turns the tiles face-down in the same location and play passes to the next player. The object is to collect the largest number of tiles.

With reference to FIG. 5, for a racing game, the tiles are laid at random in a spiral, typically starting at the center and working out. The players roll three dice to determine who plays first. Players start at the outside of the spiral and move markers from colored indicia to colored indicia to finish at the center of the spiral. Each player has two markers. Markers of different players are conveniently color coded. The player who goes first rolls three dice. A player may move his/her tokens either the total of all three dice, the sum of any pair of dice, or each token the amount shown in any two of the dice. However, at the end of each roll, both of the players markers must be on indicia of the same color.

In a more difficult variation, when the tiles are further encoded with the letter indicia 40, each of the players further seeks to land on and "collect" each of the available letters.

The tiles can be used to play a large class of games which are called solitaire games. The object of such games is to get an entire set of tiles into a certain prefixed order, such as 7 or 8 suits segregated and each suit in sequence.

In one example of a class of solitaire games, the set of tiles is dealt on the table in a layout consisting of a tableau and a hand. The tableau consists of 36 tiles arranged in 8 columns initially containing from 1 to 8 tiles. The bottom tile in each column is turned up. The hand consists of 20 tiles arranged in 2 equal columns. The tiles are turned up one at a time and played by a lone player. Tiles are played to 8 foundations in sequence and segregated by suit. Tiles are played to the tableau so the colors alternate and tiles are played to a talon in any order at all. During play, tiles are built onto the foundations. The object is to completely build the entire set onto the 8 foundations in sequence and segregated by suit.

The tiles are also amenable to being joined together on a flat surface to make many colorful symmetrical patterns. The tiles are simply joined to each other at different positions of their edges such as the base, the lower part of the wings, the top of the wings or the flattened top section. For example, 2 or 3 tiles can be joined together in about 30 different ways to make a segment. A nice design can be easily made by putting these segments in rings and other simple arrangements. Of course, single tiles can be used as well. If one chooses say 4 different segments to make a design, there would be 755,160 permutations. If this is multiplied by an uncountable number of ways which say 28 segments or tiles can be arranged, it quickly becomes clear that millions of symmetrical designs are possible.

In addition to the above briefly described games, it is to be appreciated that variations on the described games and other completely different games may also be played with these versatile tiles. Moreover, the tiles can be used such as puzzles which depend on finding a particular structural solution which is specified in terms of left and right.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. A game tile comprising:

a base;

first and second wings extending upward from the base, each wing having a central axis, the axes crossing at an angle less than 180° such that the tiles have handedness;

a rank indicia located on a face of the tile on the first wing;

a suit indicia located on the tile face on the second wing.

2. The game tile as set forth in claim 1 wherein the base is sufficiently wide that the tile stands stably on the base.

3. The tile as set forth in claim 1 wherein the central axes cross at an angle greater than 90°.

4. The game tile as set forth in claim 1 wherein the rank indicia includes a region which is color coded with one of a plurality of colors, each color indicating a different rank.

5. The game tile as set forth in claim 1 wherein the suit indicia includes a region which is color coded with one of a plurality of colors, each color indicating a different suit.

6. The game tile as set forth in claim 5 wherein the rank indicia includes a region which is color coded with one of a plurality of colors, each color indicating a different rank.

7. The game tile as set forth in claim 6 further including a pair of secondary color indicia disposed adjacent the base, a first of the secondary color indicia matching the rank color indicia and a second of the secondary color indicia matching the suit indicia.

8. The game tile as set forth in claim 7 further including a value indicia disposed adjacent the base.

9. The game tile as set forth in claim 1 further including a value indicia disposed adjacent the base.

10. The game tile as set forth in claim 1 wherein the rank indicia includes a number.

11. The game tile as set forth in claim 1 further including a plurality of like game tiles, the game tiles having a plurality of number indicia, the numbers being sequential.

12. The game tile as set forth in claim 11 wherein the suit indicia include a plurality of suit indicia, each suit indicia appearing on a plurality of tiles, one with each of the rank indicia.

13. The game tile as set forth in claim 1 wherein the game tile further includes a flat top portion opposite the base between the two wings, which flat top portion is adapted to receive the base of other like tiles.

14. A set of game tiles comprising a plurality of like shaped tiles, each tile having a face and a back, the back of each tile being substantially the same, each tile further having a pair of wings which extend from the base at an angle relative to each other and relative to the base such that the tiles have handedness, each tile having a suit indicia on one wing and a rank indicia on the other wing, the set of tiles including:

a plurality of subsets of tiles, each subset marked with one of a plurality of suit indicia;

a first of the subsets of tiles being marked with a first suit indicia and including a tile marked with each of a plurality of rank indicia;

a second of the subsets of tiles being marked with a second suit indicia and including a tile marked with each of a plurality of rank indicia.

15. The set of game tiles as set forth in claim 14 further including:

a third subset of tiles marked with a third suit indicia and including a tile marked with each of a plurality of rank indicia;

a fourth subset of tiles marked with a fourth suit indicia, and including a tile marked with each of a plurality of rank indicia.

16. The set of game tiles as set forth in claim 15 having like suit and rank indicia and handedness in combination with a means for differentiating suit from rank.

17. The tile set as set forth in claim 14 wherein each tile has sufficient width at its base that the tile stands stably, vertically on its base.

18. The tile set as set forth in claim 14 wherein the suit and rank indicia are color coded, the suit and rank indicia being differentiable.

19. The tile set as set forth in claim 14 wherein the rank indicia includes a series of consecutive numbers.

20. The set of tiles as set forth in claim 14 wherein each tile carries on its face a value indicia.

* * * * *